United States Patent [19]

Kirk

[11] Patent Number: 4,664,264

[45] Date of Patent: May 12, 1987

[54] CARD FOR HOLDING AND DISPLAYING JEWELRY

[76] Inventor: Alexis V. Kirk, 385 Fifth Ave., New York, N.Y. 10016

[21] Appl. No.: 820,547

[22] Filed: Jan. 17, 1986

[51] Int. Cl.[4] ..... A47F 7/00

[52] U.S. Cl. ..... 211/13; D9/456

[58] Field of Search ..... 211/13, 4; 248/442, 248/114–116, 309.1; 206/481, 478, 477, 556; 40/124.2; D9/457, 456, 499

[56] References Cited

U.S. PATENT DOCUMENTS 4,155,457 5/1979 Wilbert ..... 211/4

4,322,007 3/1982 Feibelman ..... 211/13 X 4,391,375 7/1983 Joyce ..... 211/13

4,442,942 4/1984 Cuminale et al. ..... 211/13 X

*Primary Examiner*—Robert W. Gibson, Jr.

*Assistant Examiner*—Sarah A. Lechok Eley

*Attorney, Agent, or Firm*—Frishauf, Holtz, Goodman & Woodward

[57] ABSTRACT

A card for holding and displaying earrings and other jewelry, comprises a front card member of substantially rigid material; and a band member which is mounted across the front member so as to resiliently provide a space between the band and the front member when a clasp is inserted therebetween, for secure mounting and display of the earrings or other jewelry, while also permitting easy removal thereof from the card. Preferably, the front card member has some flexibility.

22 Claims, 21 Drawing Figures

CARD FOR HOLDING AND DISPLAYING JEWELRY

CROSS-REFERENCE TO RELATED APPLICATION

U.S. Design Application Ser. No. 812,953, filed Dec. 24,1985, in the name of Alexis Kirk.

BACKGROUND OF THE INVENTION

This invention relates to a display card for holding and displaying jewelry, and more particularly, to such a display card for holding and displaying earrings at a point- of-sale display where the earrings can be easily observed by a prospective purchaser and easily removed from the display card without damaging the card and without damaging the earrings.

Prior art earring display cards generally have openings within which the clasp of the earring is insertable to bear against the rear surface of the card. The cards are generally inverted L-shaped in side view and are displayed at an incline, usually suspended from a rod-shaped support member or the like. When the earrings are removed from the conventional card for inspection by a prospective purchaser, very often the prospective purchaser has difficulty removing the earrings and damages the earring clasp by, for example, bending same. Such damage may reduce the holding force of the earring clasp, and render the earrings defective and unsuitable for sale. While the following description is given for earrings (clasp-type and pierced ear-type), the invention is equally applicable to other clasp-type jewelry such as pins, medallions, or the like.

The object of the present invention is to provide a simple, attractive, easy-to-manufacture, but yet very effective jewelry holding and display card from which the jewelry (particularly earrings) can be easily removed without damaging a jewelry clasp or the card.

It is a further object of the invention to provide a jewelry holding and display card which can hold and display not only clasp-type earrings and other jewelry, but also pierced ear-type earrings and other post mounted jewelry such as pins, or the like.

SUMMARY OF THE INVENTION

According to the invention, a card for holding and displaying jewelry comprises a front card member formed of a substantially rigid material; and a band member extending from a first portion to a second portion along the width of the front card member, the band having opposite end portions which are secured to the front card member. The band member and front card member are relatively resilient with respect to each other so as to provide a space therebetween when a clasp of an earring, pin or the like is inserted therebetween. The clasp of the earring or pin "clips" onto the band member and is easily removable therefrom by being slidable off of the band member.

Preferably, the band member has respective ends which pass around side portions of the front member, and which are secured to a rear surface of the front member. The front card member preferably has flexibility.

DETAILED DESCRIPTION

The following description is given with reference to earrings, it being understood that other similar jewelry articles are included within the scope of the invention.

Figure 16:
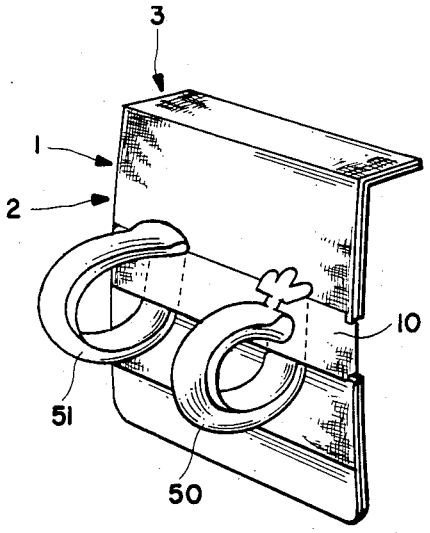
FIG. 16 is a perspective view showing a pair of earrings mounted on the card of FIG. 1.
Figure 17:
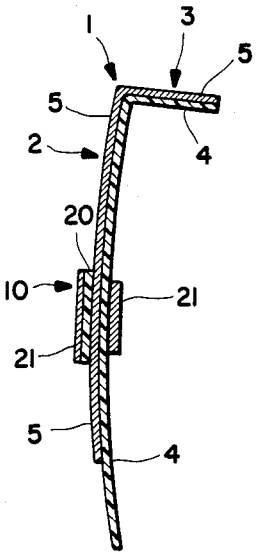
FIG. 17 is a cross-sectional view taken along the line 17—17 in FIG. 1.

Referring to FIGS. 1–6, and 16–18, a first embodiment of the invention comprises a card 1 which is generally L-shaped, the card comprising a front portion 2 and a top portion 3. The front and top portions 2 and 3, in the illustrated embodiment, comprise an underlying L-shaped plastic sheet-like member 4 which is at least partially covered by a fabric layer, such as velvet 5. The plastic sheet 4 is substantially rigid, but may have some bendability or flexibility. Preferably, the plastic sheet 4 is made of polypropylene and is approximately 0.002 inches thick. The card further comprises a substantially rigid, but bendable band 10 which, as seen in FIG. 17, is made of a plastic underlying sheet-like layer 20 covered with preferably the same fabric 21 (i.e., velvet) in order to match the front surface of fabric layer 5 of the card 1.

The card 1 has notches 11, 12 formed in opposite sides thereof, in which the band 10 is mounted. The band 10 passes through the notches 11, 12 and wraps around to the rear surface of the card 1. See FIGS. 1–6, 16 and 18. The free ends 13, 14 of the band 10 are adhered to the rear surface of the plastic layer 4, for example by means of a double sided adhesive tape or other suitable means. The plastic sheet-like layer 20 underlying the fabric outer covering 21 of the band 10 is preferably substantially the same as the plastic sheet-like layer 4;that is, it is substantially rigid but preferably has some resiliency or flexibility so that the band 10 can flex outwardly relative to the front surface of the card 1 so as to insert a clasp of an earring between the band 10 and the front portion 2 of the card 1, as shown in FIG. 16.

Figure 4:
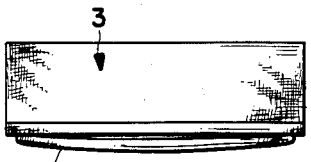
FIG. 4 is a top view thereof.
Figure 5:
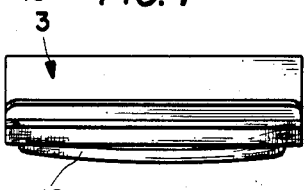
FIG. 5 is a bottom view thereof.
Figure 6:
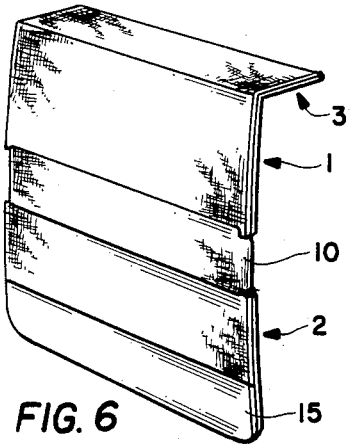
FIG. 6 is a perspective view thereof.

The top view of FIG. 4 shows the band 10 slightly bowed outwardly so as to provide some space between band 10 and front portion 2 within which to insert the clasp of an earring.

The lower area 15 of the front portion 2 of the card 1 is preferably uncoated by fabric. Advertising, such as the name of the earring manufacturer, or the like, may be applied to the front surface of the lower area 15; that is, to the exposed front surface portion 15 of plastic layer or sheet 4.

Figure 2:
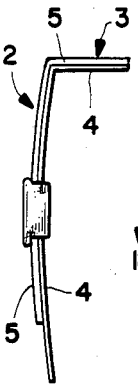
FIG. 2 is a right side view thereof, the left side view being a mirror image.

As seen from the side view of FIG. 2, and from the cross-sectional view of FIG. 17, the fabric layer 5 is preferably adhered to the underlying plastic member 4 by means of an adhesive. Alternatively, the fabric layer 5 can be heat sealed or heat bonded to the plastic sheet or layer 4.

Figure 18:
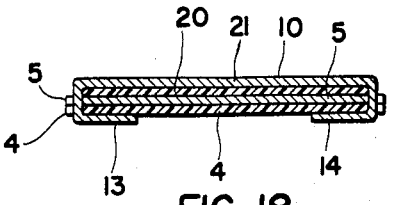
FIG. 18 is a cross-sectional view taken along the line 18—18 in FIG. 3.

As seen in FIG. 18, the ends 13, 14 of the band 10 which wrap around to the rear surface of the plastic member 4 of the front portion 2 are fabric portions. The plastic layer 20 of band 10 only extends along the front surface of front portion 2. This arrangement provides a greater degree of resiliency of the band 10, while also securely retaining the band 10 in position. The slight resiliency of the fabric layer end portions 13, 14 aids in mounting the earrings on the band, since the band may more easily flex away from the front surface of the front portion 2.

Alternatively, the complete band 10 may be fabricated of a fabric layer 21, the plastic under member 20 being eliminated. A disadvantage of this arrangement is that the fabric layer 21 will not be as sturdy and will not stand up to repeated use, contrary to the band 10 which includes the stiffening plastic layer 21. In the case where the band 10 is fabricated only of a fabric layer 21, the fabric layer 21 is preferably of a relatively sturdy fabric so that it can retain its shape and stand up to repeated use. When the band 10 is fabricated only of a fabric layer, the fabric layer can be strengthened by coating it with a plastic layer or some other stiffening agent to increase its rigidity and thereby improve its shape retention and durability.

Figure 7:
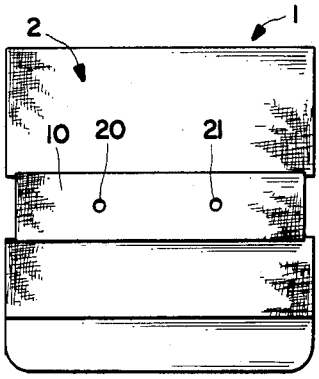
FIG. 7 is a front view of a modified embodiment having holes for receiving pierced ear-type earrings.

FIG. 7 shows a modified embodiment similar to FIGS. 1–6, but in which holes 20, 21 are provided through the band 10 and through the front portion 2 of the card 1. When the card is used to mount pierced earrings, the posts of the pierced earrings are passed through the holes 20, 21 and the clutches of the earrings are secured to the posts at the rear surface of the card 1 to retain the earrings on the card, in a conventional manner. Thus, the same card can be used for both clasp-type earrings (wherein the clasp is passed between the band 10 and the front portion 2 of the card, as shown in FIG. 16) or for pierced ear-type earrings wherein the posts of the earrings are mounted through holes 20, 21, respectively.

Figure 8:
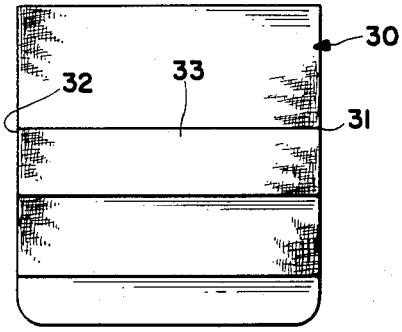
FIG. 8 is a front view of a modified embodiment thereof.
Figure 9:
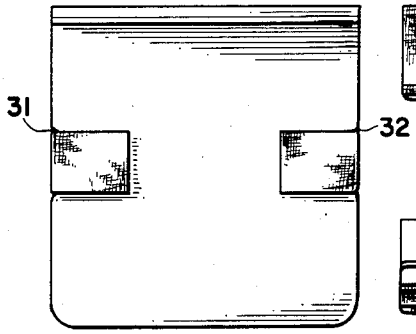
FIGS. 9–11 are rear, top and bottom views of the embodiment of FIG. 8.
Figure 10:
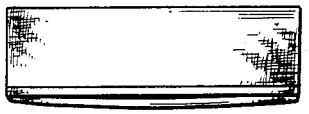
Figure 11:
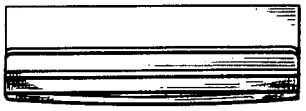
Figure 12:
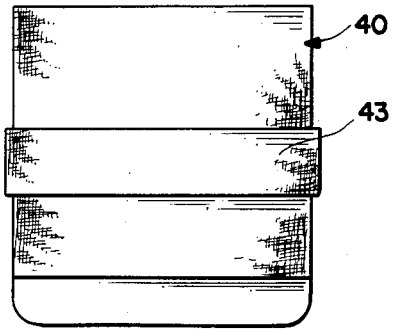
FIG. 12 is a front view of a further modified embodiment thereof.

FIGS. 8–11 illustrate a modified embodiment wherein the card 30 has very small notches 31, 32 formed in the side surfaces thereof to receive the band 33 so that the band 33 is flush with the sides of the card 30, as seen best in FIGS. 8 and 9. The depth of the slots or notches 31, 32 is substantially equal to the overall thickness of the portion of band 33 which wraps around the side edges of the card 30. In all other respects, the embodiment of FIGS. 8–11 is substantially the same as the embodiment of FIGS. 1–6. Holes 20, 21 could be provided in the embodiment of FIGS. 8–11, as shown in FIG. 7.

FIGS. 12–15 illustrate a further emboidment wherein the card 40 has no notches on the side thereof (i.e., the side edges of the card 40 are straight), and the band 43 wraps around the straight longitudinal side edges of the card 40 and projects outwardly therefrom. In all other respects, the embodiment of FIGS. 12–15 is the same as the embodiment of FIGS. 1–6. Holes 20, 21 as shown in FIG. 7 can also be provided in the embodiment of FIGS. 12–15.

Figure 3:
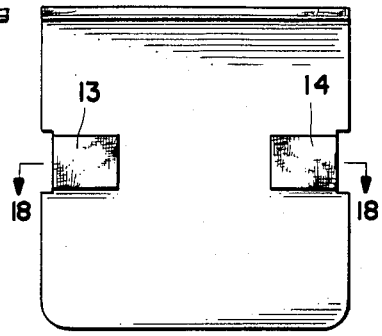
FIG. 3 is a rear view thereof.

In the embodiments of FIGS. 8–11 and FIGS. 12–15, the end portions of the bands 33, 43, which wrap around to the rear surfaces of the cards 30, 40, respectively, are adhered to the rear surfaces of the respective cards, in the same manner as shown in FIG. 3, for example by an adhesive or the like, or by double-sided adhesive tape, or other suitable means.

Figure 19:
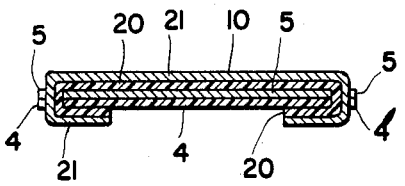
FIG. 19 shows a further modified embodiment.

Preferably, the bands 10, 33, 43 are composite structures having a plastic under layer 20 and a fabric layer 21 applied to the outer side of the plastic layer 20, at least over the portion thereof which covers the front surface of the respective cards. The end portions 13, 14 (see FIG. 3) and the end portions of the bands in FIGS. 9 and 13, which overlie the rear surface of the front member 2, preferably are only the fabric portions of the respective bands, for ease of manufacture and for excellent flexibililty of the bands relative to the front portions of the cards. Alternatively, the plastic under layer 21 may wrap around to the rear so that a plastic-to-plastic surface connection is made against the rear surface of the respective cards, as seen in FIG. 19. This facilitates adhering the bands to the cards by means of a solvent-type adhesion substance, or heat sealing, which is conventionally used to adhere one plastic surface to another.

Earrings (shown in FIG. 16 as "clasp type") can be inserted from the top, as shown by earring 50 in FIG. 16, or they can be inverted and inserted on the band 10 from the bottom, as shown by earring 51 in FIG. 16. The clasping action of the earring clasp is sufficient to retain the earrings on the band 10. However, more secure retention is obtained when the earrings are inserted from the top, thereby preventing the earrings from sliding off the band.

It should be clear that the display card need not be generally L-shaped as shown in FIG. 2. A substantially flat card member can be used, as desired. However, a flat card cannot be hung or mounted on most presently available display racks, etc. Also, a lower portion of the card (such as lower portion 15) can be bent downwardly so as to be substantially parallel to surface 3 (see FIG. 2) to provide a generally U-shaped member for insertion into boxes for holding and displaying earrings, or the like.

Still further, the width of the band 10, 33, 43 need not be as shown in FIGS. 1–17. It can be wider or narrower. It is preferred that the band be substantially as wide as the length of the earring clasp, or longer. If the band is too narrow, the earrings will not be securely supported and will "flop" around on the card.

Figure 20:
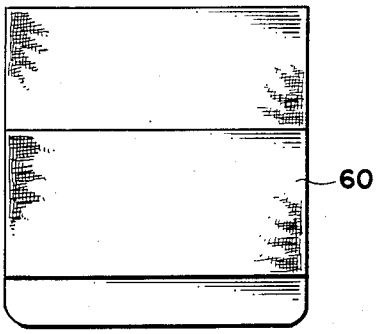
FIG. 20 shows still another modified embodiment.

FIG. 20 shows an embodiment of the invention with a large "band" which replaces the bands 10, 33, 43 discussed hereinabove. The operation and construction is substantially the same as for the other embodiments (including all of the modifications thereof), except that earrings are only insertable from the top in the construction of FIG. 20. The large band 60 in FIG. 20 can take any of the constructive discussed hereinabove, and can be attached to the card in any of the matters discussed hereinabove. Also, the cards may have notches, or no notches, to receive the sides of the band 60, as desired. Still further, the band 60 and its associated front card can have holes similar to holes 20, 21 of FIG. 7 to accept pierced ear-type earrings.

Figure 1:
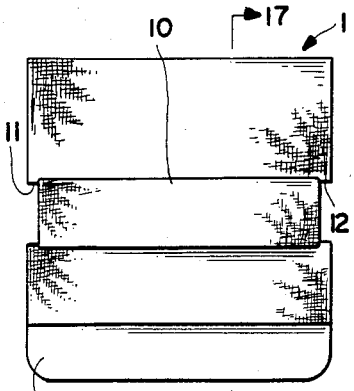
Fig. 1 is a front view of a first embodiment of the present invention.

If a larger display card is desired, the cards can be elongated in the vertical direction as seen in FIG. 1 and a plurality of bands 10 can be mounted thereon at spaced intervals along the length thereof, so as to provide support or mounting bands for a plurality of pairs of earrings. In some display constructions, such an arrangement may be preferable. Also, a plurality of cards or card sections can be provided side-by-side in the width direction of the card (as seen in FIG. 1) to provide a mounting arrangement for a plurality of pairs of earrings.

Figure 13:
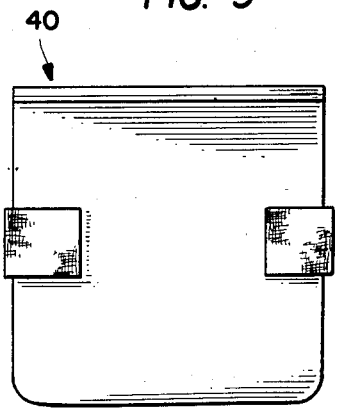
FIGS. 13, 14 and 15 are respectively rear, top and bottom views of the embodiment of FIG. 12.
Figure 14:
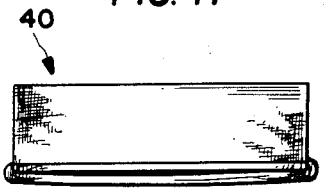
Figure 15:
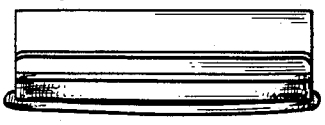
Figure 21:
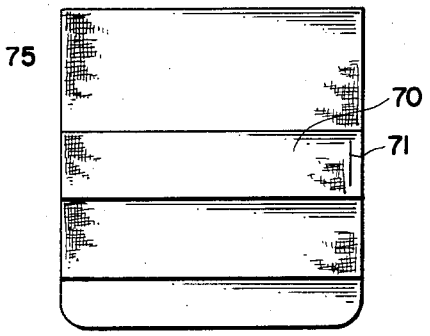
FIG. 21 shows yet another modified embodiment.

FIG. 21 illustrates a further embodiment wherein the band 70 is secured to the front surface of the card 75, instead of having ends which wrap around to the rear of the card 75 as shown in FIGS. 3, 9 and 13. In FIG. 21, the band 70 may be secured to the front surface of the card 75, for example by means of staples 71 (shown at right side of band 70), rivets or other mechanical connections or band 70 could be adhesively connected at the ends thereof, for example as shown at the left end of band 70 in FIG. 21. The adhesive is not shown since it is present under the left end portion of the band 70 to adhere the band 70 to the card 75. While this construction does not provide as secure a connection as when wrapping the ends of the band around to the rear surface of the card, in some instances it may be desired to fabricate the article as shown in FIG. 21.

In a preferred embodiment, the front card member is made of a sheet of plastic 4 with velvet fabric 5 secured to the front surface thereof. The front member is approximately three and three quarter inches high, two and three quarter inches wide, and the band 10 is approximately one half inch wide (in the vertical direction of the card). The band also has the portion which overlies the front surface of the card made of a plastic layer, covered with a velvet layer to match the front surface of the card. Preferably, the band 10 is at least one half inch wide in order to provide for stable mounting of the earrings or other jewelry connected thereto.

Preferably, the fabric layers 5, 21 of the front card member and the band, respectively, are velvet or similar materials. Velvet has a "pile" type of surface which improves the integrity of the engagement of the clasp with the surface of the band. That is, the velvet provides a higher coefficient of friction than does merely a plastic substantially rigid member, such as sheet-like members 4 and 20. Other types of fabric layers could be used, but plush, pile type layers are preferable from the point of view of appearance (luxurious appearance) and functionality. Additionally, the under surface of the bands 10, 33, 43 can be provided with a fabric layer 21 (not shown). In this case, referring to FIG. 17, the band 10 would include another fabric layer 21 interposed between the plastic layer 20 and the fabric layer 5 of the front card member. In such a case, the additional fabric layer underneath of the band 10 would also extend around to the rear surface of the front card member to connect to the rear surface of the front card member, as in the same manner as shown in FIG. 18. Such an arrangement has the advantage of completely covering the plastic member 20 of the band 10. A single sheet of fabric can be used which wraps around from the front surface of the band 10, over the elongated horizontal edges (see FIG. 1) of the band 10, the elongated edges of the fabric layer meeting at the rear surface of the band 10. The meeting line of the edges of the resulting fabric layer is not seen, since it is underneath the band 10.

All of the Figures are not drawn to the same scale. In the cross-sectional figures, thickness of materials is exaggerated for ease of illustration.

It should be clear that various other modifications could be made within the scope of the invention as set forth in the appended claims.

I claim:

1. A card for holding and displaying at least one article of jewelry, comprising:

a front card member formed of a substantially rigid sheet-like material; and a sheet-like band member extending from spaced apart first and second portions of said front card member, said band member having opposite end portions which are secured to said front card member, said band member having a surface facing said front card member and an opposite surface facing away from said front card member;

said front card member having a given dimension in a direction transverse to the extending direction of said band member, said band member having a dimension in said transverse direction which is less than said given dimension;

said band member and said front card member being relatively resilient with respect to each other so as to provide a space therebetween and between said opposite end portions of said band member when a clasp of a jewelry article is inserted in said space in said transverse direction with another portion of said jewelry article adjacent said opposite surface of said band member:

whereby said jewelry article is removable from said card by sliding same off of said band member is said transverse direction.

2. The card of claim 1, wherein said band member has respective ends which extend around spaced apart side portions of said front card member, and which are secured to a rear surface of said front card member.

3. The card of claim 2, wherein said front card member comprises a substantially rigid plastic sheet member, having flexibility and wherein at least a portion of said band member comprises a plastic sheet member overlying said plastic sheet member of said front card member.

4. The card of claim 3, wherein at least a substantial portion of the front surface of said plastic sheet member of said front card member is covered with a fabric layer, and wherein at least a portion of said plastic sheet member of said band member is covered with a fabric layer.

5. The card of claim 4, wherein said fabric layer of said band member extends around to the rear surface of said front card member, said band member being adhered to said rear surface of said front card member.

6. The card of claim 5, wherein said band member has free ends which are adhered to said rear surface of said front card member.

7. The band of claim 5, wherein said plastic sheet member of said band member ends short of the part of said band member which extends around to said rear surface of said front card member, only said fabric layer of said band member extending around to the rear surface of said front card member and being adhered to said rear surface of said front card member.

8. The band of claim 7, wherein said fabric layer of said band member has free ends, said free ends being adhered to said rear surface of said front card member.

9. The card of claim 3, wherein said plastic sheet member of said band member extends around to the rear surface of said front card member, said band member being adhered to said rear surface of said front card member.

10. The card of claim 9, wherein at least a substantial portion of the front surface of said plastic sheet member of said front card member is covered with a fabric layer, and wherein at least a portion of said plastic sheet member of said band member is covered with a fabric layer.

11. The card of claim 1, wherein said band member has respective ends which are secured to a front surface of said front card member at spaced apart positions on said front surface of said front card member.

12. The card of claim 1, wherein said substantially rigid sheet-like material of said front card member is covered with a fabric layer over at least a substantial portion of the front surface thereof, and wherein said sheet-like band member is covered with a fabric layer over at least a portion thereof.

13. The band of claim 12, wherein said fabric layer covers said band member over at least the portion of said band member which is coextensive with said front surface of said front card member.

14. The card of claim 13, wherein said band member has respective ends which extend around spaced apart side portions of said front card member, and which are secured to a rear surface of said front card member, said respective ends comprising said fabric layer of said band member.

15. The card of claim 14, wherein said band member comprises a substantially rigid sheet-like material portion extending across the front surface of said front card member and terminating short of the portions of said band which extend around said spaced apart side portions of said front card member, only said fabric layer of said band member extending around said spaced apart side portions of said front card member.

16. The card of claim 1, wherein said band member has a width which is substantially greater than the width of a clasp of an article of jewelry to be mounted thereon.

17. The card of claim 1, wherein said band member has a width which is substantially equal to the length of a clasp of an article of jewelry which is to be mounted thereon.

18. The card of claim 4, wherein said fabric layer has a surface having a higher coefficient of friction than the surface of said plastic sheet members.

19. The card of claim 12, wherein said fabric layers have a coefficient of friction which is higher than that of said substantially rigid sheet-like material.

20. The card of claim 4, wherein both opposite surfaces of said band member are covered with a fabric layer.

21. The card of claim 13, wherein both opposite surfaces of said band member are covered with a fabric layer.

22. The card of claim 1, wherein said substantially rigid sheet-like material of said front card member has flexibility.

* * * * *